United States Patent [19]

Asano et al.

[11] Patent Number: 4,872,314

[45] Date of Patent: Oct. 10, 1989

[54] SUPERCONDUCTING COIL REFRIGERATING METHOD AND SUPERCONDUCTING APPARATUS

[75] Inventors: Katuhiko Asano, Hitachi; Takao Suzuki, Mito, both of Japan

[73] Assignee: Hitachi, Ltd., Tokyo, Japan

[21] Appl. No.: 280,966

[22] Filed: Dec. 7, 1988

[30] Foreign Application Priority Data

Dec. 7, 1987 [JP] Japan ..... 62-307559

[51] Int. Cl.[4] ..... F17C 13/02

[52] U.S. Cl. ..... 62/49.1; 62/50.1; 62/51.1; 174/15.4; 505/885; 505/899

[58] Field of Search ..... 62/49, 55, 514 R; 174/15.4; 335/216

[56] References Cited

U.S. PATENT DOCUMENTS

| | | | |
|---|---|---|---|
| 3,430,450 | 3/1969 | Bogner et al. | 62/49 |
| 3,835,239 | 9/1974 | Schmidt et al. | 174/15.4 |
| 4,744,222 | 5/1988 | Murai | 62/49 |

*Primary Examiner*—Ronald C. Capossela
*Attorney, Agent, or Firm*—Antonelli, Terry & Wands

[57] ABSTRACT

In a superconducting coil refrigerating method and a superconducting apparatus, a flow of liquid helium is induced in a helium vessel only at a specified time upon change of a current of the superconducting coil, before the current change and/or after the current change. The induction of the helium flow before the current change provides a condition that the transfer of helium gas bubbles which may be generated upon subsequent current change is rapidly effected. The induction of the helium flow upon the current change or after the current change results in the rapid exhaustion of helium gas bubbles which continue to generate or have been generated. With such a construction, even if a superconducting pulse magnet is used, any influence of helium gas bubbles produced due to an AC loss upon change of a current can be eliminated, thereby providing a coil which is stable to a pulse-excited magnetization thereof.

7 Claims, 3 Drawing Sheets

〈UPON INITIAL REFRIGERATION〉

〈UPON STORING OF LIQUID HELIUM OR NON-CONDUCTING STATE〉

〈UPON CHANGE OF CURRENT〉

〈CONSTANT CURRENT STATE〉

SUPERCONDUCTING COIL REFRIGERATING METHOD AND SUPERCONDUCTING APPARATUS

BACKGROUND OF THE INVENTION

The present invention relates to a superconducting coil refrigerating method and a superconducting apparatus, and more particularly to a superconducting coil refrigerating method and a superconducting apparatus suitable in the case where a pulse magnet run with fast magnetization/ demagnetization or with the repetition of magnetization and demagnetization is used.

Up to this day, there are various articles which explain refrigeration methods in superconducting devices. Technical & Research Report (Section II) No. 93 by the Institute of Electrical Engineers of Japan describes on and after page 61 an immersion refrigeration method using liquid helium and a forced refrigeration method using liquid helium (more especially, forced refrigeration by supercritical helium).

The bath cooling method using liquid helium is the most general refrigeration method. In this method, a superconducting coil is immersed in a helium tank filled with the liquid helium so that the superconducting coil is refrigerated by virtue of an effervescence heat transfer characteristic of the liquid helium. A steady state (including a liquid helium storing state and a conducting state) involves only a natural convection. Therefore, in the immersion refrigeration method, it is required that liquid helium with the amount corresponding to that of liquid helium evaporating from the helium tank due to a thermal penetration of the superconducting coil is supplied as required or continuously.

On the other hand, in the forced cooling method using liquid helium, the liquid helium is forcibly flown into or outside of a superconductor forming a superconducting coil so that the superconducting coil is refrigerated by virtue of a forced convection heat transfer characteristic of the liquid helium. Advanced development of the forced cooling method has been made since the forced convection heat transfer in the forced cooling method has a large refrigeration ability in comparison with the effervescence heat transfer in the bath cooling method. However, the forced cooling method is not yet popular as compared with the bath cooling method. In the case of the forced cooling method, the flow of liquid helium is forcibly formed always over the initial refrigeration stage of the superconducting coil, the liquid helium storing state and the conducting state.

In order to ascertain the stability of a superconducting coil, the refrigeration of the coil is one of important tasks. Especially, in the case of a pulse magnet which is run with fast magnetization/demagnetization or with the repetition of magnetization and demagnetization, the problem of refrigeration is particularly important since there are always present the generation of heat from the coil itself due to an AC loss generated from a superconductor itself and a structure surrounding it and the generation of helium gas bubbles attendant upon the heat generation.

In the light of the above point of view, the above-mentioned conventional refrigeration methods have the following problems to be solved with respect to the superconducting pulse magnet. Namely, in the case of the bath cooling method, though a stable refrigeration characteristic is obtained because the liquid helium is stagnant or not flowing, there is a problem that the transfer (or migration) and exhaustion of helium gas bubbles generated is difficult and hence the stagnation of the bubbles causes the deterioration of effervescence heat transfer characteristic at the surface of the superconductor and hence the degradation of the stability of the superconducting coil. In the case of the forced cooling method, on the other hand, though it is advantageous in the improvement of the refrigeration performance and the migration or movement of helium gas bubbles owing to the forced convection heat transfer, there is a problem of uncertainty attendant upon the flow of liquid helium or a possibility that a change of flow distribution in and/or a flow stagnation in parallel channels take place. As a result, the reliability of the forced cooling method is questionable and hence it is difficult to keep the stability of the coil continually. Further, the continuous forced flow of liquid helium causes a so-called flash loss. Namely, a pressure is imposed on the liquid helium so that the liquid helium is partially gasified, thereby degrading the quality of the liquid helium. Such a flash loss is not preferable for the refrigeration characteristic of the coil.

SUMMARY OF THE INVENTION

An object of the present invention made in the light of the above-mentioned problems is to provide a superconducting coil refrigerating method and a superconducting apparatus in which even if a superconducting pulse magnet is used, any influence of helium gas bubbles produced due to an AC loss upon change of a current can be eliminated, thereby providing a coil which is stable to a pulse-excited magnetization thereof.

How to evade the stagnation of helium gas bubbles due to the AC loss which is a defect of the bath cooling method is important for the attainment of the above-mentioned object. This problem can be solved by producing a forced flow of liquid helium so that the helium gas bubbles are rapidly transferred and exhausted. Namely, in a state in which no current change is present and hence no AC loss is present, the bath cooling which is a reliable refrigeration condition is made, thereby keeping the stabilization of the coil surely. In that case, no forced flow of liquid helium exists but only a flow of liquid helium based on the natural convection exists. On the other hand, upon generation of the AC loss when a current changes, a forced flow of liquid helium is properly induced upon change of the current, before the current change and/or after the current change so that helium gas bubbles produced due to the AC loss are rapidly exhausted.

Thus, the aimed object of the present invention can be attained by inducing a flow of liquid helium in a helium vessel only at a specified time upon current change, before the current change and/or after the current. The induction of the helium flow before the current change provides a condition that the transfer of helium gas bubbles which may be generated upon subsequent current change is rapidly effected. The induction of the helium flow upon the current change or after the current change result in the rapid exhaustion of the helium gas bubbles which continue to generate or have been generated.

DESCRIPTION OF THE PREFERRED EMBODIMENTS

The present invention will now be explained on the basis of embodiments thereof shown in accompanying drawings.

Figure 1:
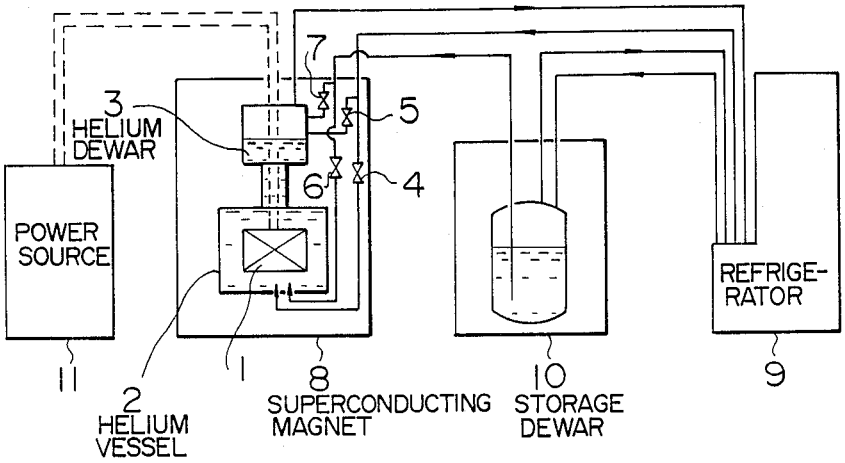
FIG. 1 is a systematic view showing an embodiment of a superconducting apparatus according to the present invention.

FIG. 1 shows an embodiment of the present invention. In FIG. 1, a superconducting coil 1 is immersed in a helium vessel 2 which is filled with liquid helium. The helium vessel 2 communicates with a helium dewar or tank 3 so that the helium dewar 3 is partially filled with the liquid helium. The superconducting coil 1, the helium vessel 2 and the helium vessel 3 form a superconducting magnet 8. Reference numeral 9 designates a refrigerator for refrigerating the superconducting magnet 8, and numeral 10 designates a storage dewar. The refrigerator 9 and the storage dewar 10 are connected to the helium vessel 2 and the helium vessel 3 through a piping system which is provided with valves 4, 5, 6 and 7 in the course thereof. Reference numeral 11 designates a power source for magnetizing the superconducting coil 1. The power source 11 causes a current to flow in the superconducting coil 1 through leads (shown by dotted lines in FIG. 1).

Next, a function in the present embodiment will be explained. In a period of time when initial refrigeration of the superconducting coil 1 is made and in a period of time when the liquid helium is stored, the refrigerator 9 is run with the valve 4 being opened and the valve 5 being closed. When the storing of liquid helium has been completed, the valve 5 is opened and the valve 4 is closed. This state is a liquid helium supply (or feed) mode or corresponds to so-called bath cooling. Thereafter, in the conventional method, this mode is maintained even in a pulse running state. However, in the present embodiment, the valve 4 is opened at a specified time upon change of a current, at a specified time before the current change and at a specified time after the current change (with the valve 5 remaining opened or being closed). Thereby, a flow of liquid helium is forcibly induced in the helium vessel 2 so that helium gas bubbles produced due to an AC loss generated at the superconducting coil 1, etc. are rapidly exhausted to the helium dewar 3. As a result, there can be provided a superconducting coil which is stable to a pulse-excited magnetization thereof.

A similar function or effect is obtained when in a running mode of liquid helium feed from the storage dewar 10 the manipulation of the valves 6 and 7 is carried out in a manner similar to that of the valves 4 and 5 for the refrigerator 9.

An example of the opening/closing control of the valves has been explained. However, the present invention is not limited to the explained example. Any combination of the valves can be used so long as the above-mentioned function is attained.

Next, detailed explanation of the opening/closing of the valves and the flow of liquid helium upon initial refrigeration, upon storing of liquid helium or in a non-conducting state, upon change of a current and in a constant current state will be made by virtue of FIGS. 2 to 5. In the figures, thick line represents the flow of helium, a valve on which black is laid represents a closed condition of the valve, and a valve on which black is not laid represents an open state of the valve.

Figure 2:
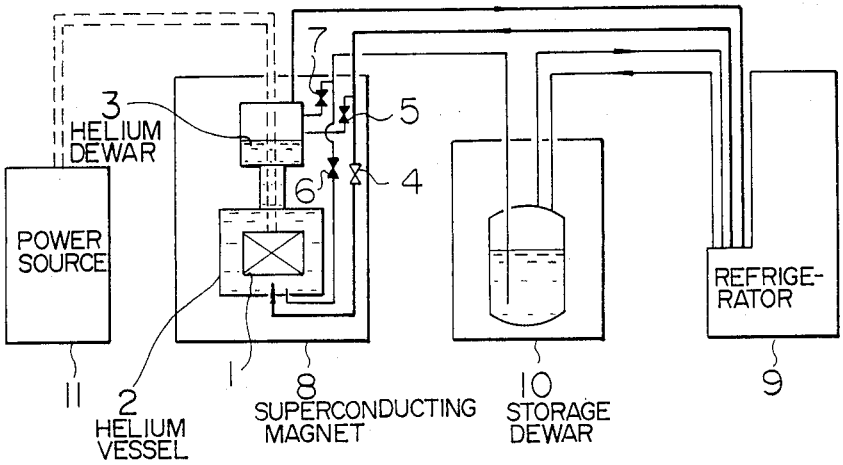
FIGS. 2 to 5 are views a concrete running procedure in the embodiment shown in FIG. 1, more particularly, FIG. 2 being a systematic view when initial refrigeration is made, FIG. 3 being a systematic view when liquid helium is stored or when no current is flown, FIG. 4 being a systematic view when the current changes, and FIG. 5 being a systematic view when the current is constant.
Figure 3:
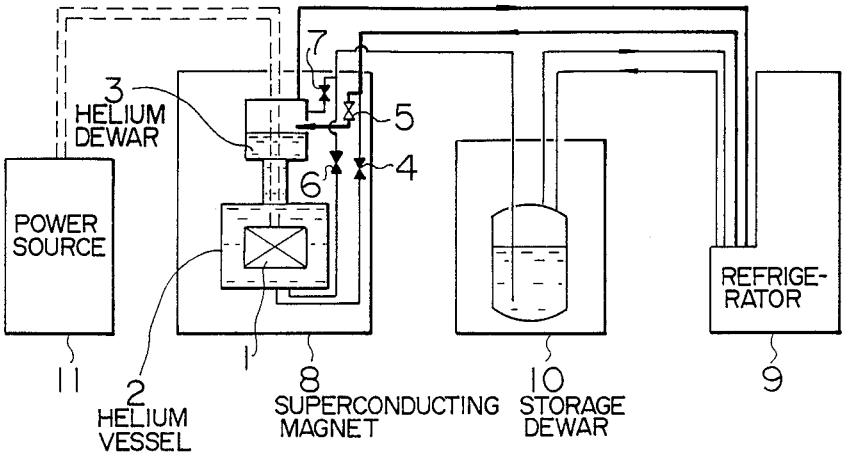
Figure 4:
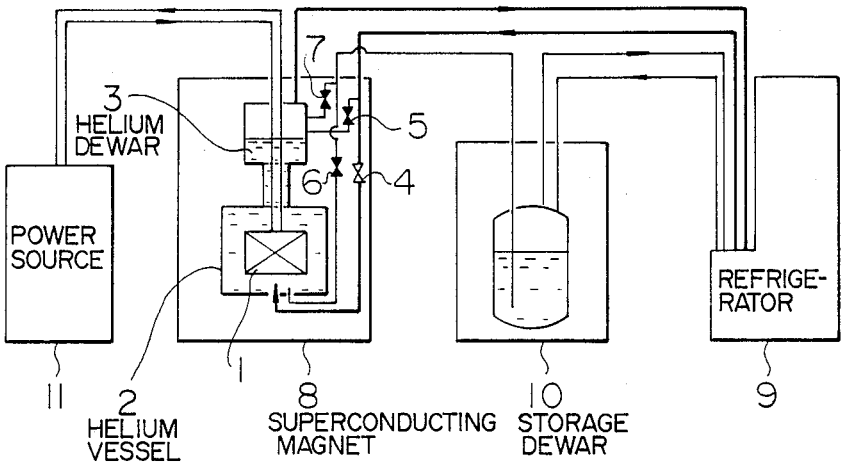
Figure 5:
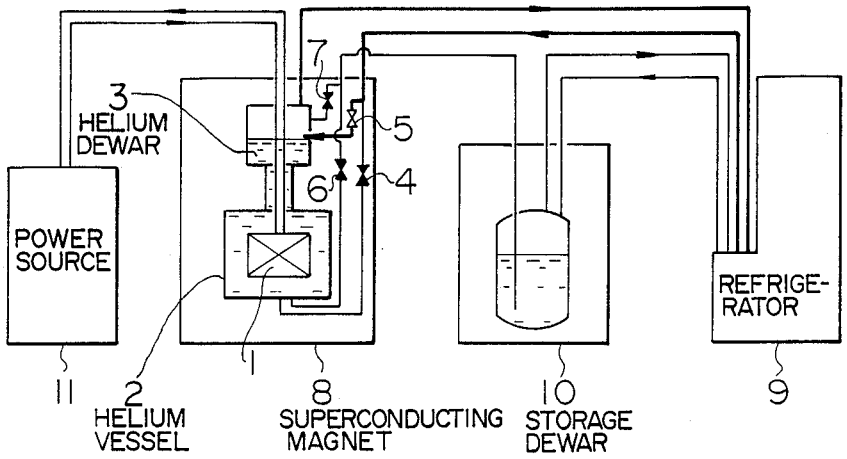

In FIG. 2 showing a state upon initial refrigeration, the valve 4 is opened with the valves 5, 6 and 7 being closed, so that helium is supplied from the refrigerator 9 to the helium vessel 2 while helium gases evaporating from the helium dewar 3 are collected to the refrigerator 9. In FIG. 3 showing a state upon storing of liquid helium or a non-conducting state, the valve 5 is opened with the valves 4, 6 and 7 being closed, so that helium is supplied from the refrigerator 9 to the helium dewar 3 while helium gases evaporating from the helium dewar 3 are collected to the refrigerator 9. A situation involved in FIG. 4 showing a state upon change of a current has already been explained in conjunction with the embodiment shown in FIG. 1. Namely, the valve 4 is opened with the valves 5, 6 and 7 being closed, thereby supplying helium from the refrigerator 9 to the helium vessel 2 to induce a forced flow of liquid helium in the helium vessel 2 so that helium gas bubbles generated in the helium vessel 2 are rapidly transferred and exhausted to the helium dewar 3. Helium gases evaporating from the helium dewar 3 are collected to the refrigerator 9. A situation in FIG. 5 showing a constant current state is quite similar to the above-mentioned situation in FIG. 3 showing the state upon storing of liquid helium or the non-conducting state.

In the above-mentioned embodiment, the forced flow of liquid helium has been induced by the opening/ closing of valves. However, any means can be used so long as it can induce the forced flow of liquid helium upon change of a current, before the current change and after the current change.

Figure 6:
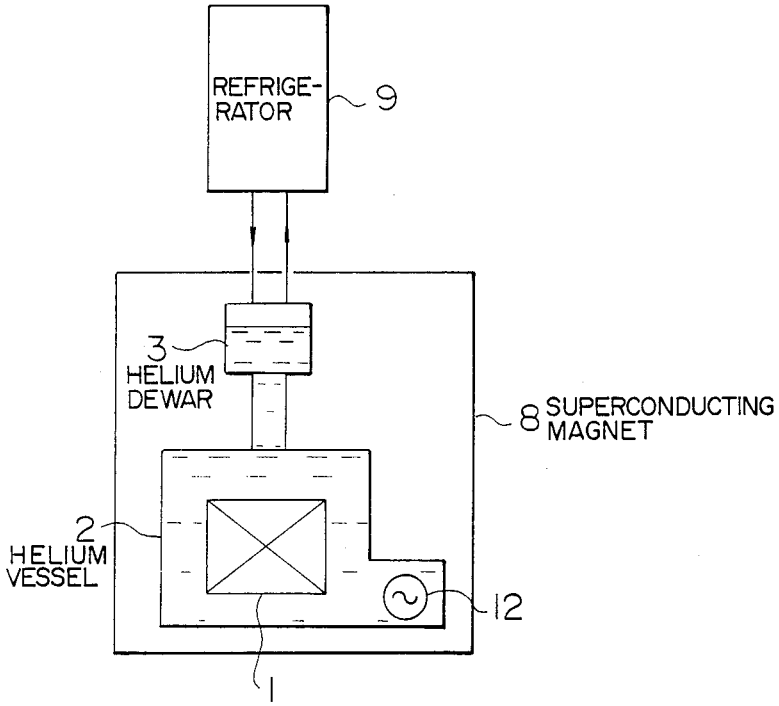
FIG. 6 is a schematic view showing the construction of another embodiment of the present invention.

Another embodiment is shown in FIG. 6 by way of example. In the present embodiment, the above-mentioned object of the present invention is achieved in a manner that an agitator 12 for producing a flow of liquid helium is placed in a helium vessel 2 in which a superconducting coil 1 is accommodated or in a system including the helium vessel 2. In a steady state, the apparatus is run so as to supply liquid helium to a helium dewar 3. At certain specified times upon change of a current, before the current change and after the current change, the agitator 12 is actuated to produce a flow of liquid helium.

The agitator 12 may be of any type so long as it produces the flow of liquid helium. For example, a liquid helium pump can be used.

In the foregoing embodiments, the induction of the flow of liquid helium in the helium vessel has been made upon change of a current, before the current change and after the current change. However, it should be noted that a similar effect can be obtained so long as the flow of liquid helium is induced in the helium vessel at at least one of a specified time upon change of the current, a specified time before the current change and a specified time after the current change.

As has been explained above, according to the superconducting coil refrigerating method and the superconducting apparatus of the present invention, in a state in which no current change is present and hence no AC loss is present, the bath cooling which is a reliable refrigeration condition is made, thereby keeping the stabilization of the coil surely. On the other hand, upon generation of the AC loss when the current change is present, a forced flow of liquid helium is properly produced upon change of the current, before the current change and/or after the current change so that helium gas bubbles generated due to the AC loss are rapidly exhausted. As a result, a coil can be provided which is stable to a pulse-excited magnetization thereof. The present invention is very effective to a superconducting apparatus in which a pulse magnet is used.

We claim:

1. A superconducting coil refrigerating method in which a superconducting coil immersed in liquid helium in a helium vessel is refrigerated by producing a flow of liquid helium in said helium vessel at at least one of a specified time upon change of a current of said superconducting coil, a specified time before the current change and a specified time after the current change.

2. A superconducting coil refrigerating method in which a superconducting coil immersed in liquid helium in a helium vessel is refrigerated by forcibly producing a flow of liquid helium in said helium vessel at at least one of a specified time upon change of a current of said superconducting coil, a specified time before the current change and a specified time after the current change.

3. A superconducting coil refrigerating method in which a superconducting coil immersed in liquid helium in a helium vessel is refrigerated by forcibly inducing a flow of liquid helium in said helium vessel by virtue of liquid helium supplied from a refrigerator to said helium vessel at at least one of a specified time upon change of a current of said superconducting coil, a specified time before the current change and a specified time after the current change.

4. A superconducting coil refrigerating method in which a superconducting coil immersed in liquid helium in a helium vessel is refrigerated by agitating the liquid helium in said helium vessel at at least one of a specified time upon change of a current of said superconducting coil, a specified time before the current change and a specified time after the current change to produce a forced flow of liquid helium in said helium vessel.

5. A superconducting coil refrigerating method in which the supply of liquid helium for refrigeration of a superconducting coil in a helium vessel and the supply of liquid helium with the amount corresponding to the amount of decrease of the liquid helium in said helium vessel due to evaporation therefrom to a helium dewar communicated with said helium vessel are made by a refrigerating system in such a manner that upon initial refrigeration of said superconducting coil the liquid helium is supplied from said refrigerating system to said helium vessel and at a constant current state of said superconducting coil, at a nonconducting state of said superconducting coil and upon storing of liquid helium the liquid helium is supplied from said refrigerating system to said helium dewar while at at least one of a specified time upon change of a current of said superconducting coil, a specified time before the current change and a specified time after the current change the liquid helium is supplied from said refrigerating system to said helium vessel independently of the supply of liquid helium upon the initial refrigeration of said superconducting coil so that a forced flow of liquid helium is produced in said helium vessel.

6. A superconducting apparatus comprising:

a helium vessel for accommodating a superconducting coil immersed in liquid helium;

a helium dewar which is communicated with said helium vessel and to which liquid helium is supplied with the amount corresponding to the amount of decrease of the liquid helium in said helium vessel due to evaporation therefrom;

a refrigeration source for supplying liquid helium to said helium dewar and said helium vessel;

a piping system for connecting said refrigeration source with said helium vessel and said helium dewar, said piping system having in the course thereof valves which are opened/closed as desired; and means for inducing a forced flow of liquid helium in said helium vessel at at least one of a specified time upon change of a current of said superconducting coil, a specified time before the current change and a specified time after the current change.

7. A superconducting apparatus comprising:

a helium vessel for accommodating a superconducting coil immersed in liquid helium;

a helium dewar which is communicated with said helium vessel and to which liquid helium is supplied with the amount corresponding to the amount of decrease of the liquid helium in said helium vessel due to evaporation therefrom;

a refrigeration source for supplying liquid helium to said helium dewar and said helium vessel;

a piping system for connecting said refrigeration source with said helium vessel and said helium dewar, said piping system having in the course thereof valves which are opened/closed as required; and an agitator provided in said helium vessel for producing a forced flow of liquid helium in said helium vessel at at least one of a specified time upon change of a current of said superconducting coil, a specified time before the current change and a specified time after the current change.

* * * * *